United States Patent [19]

Inagaki

[11] Patent Number: 5,054,136

[45] Date of Patent: Oct. 8, 1991

[54] BED WITH A BATH-TUB

[76] Inventor: Jitsuo Inagaki, 71, Aza Kamiyashiki, Oaza Itsusiki, Itsusikicho Hazugun, Aichi, Japan

[21] Appl. No.: 424,817

[22] Filed: Oct. 20, 1989

[51] Int. Cl.[5] ..... A61H 33/00; A61G 7/02

[52] U.S. Cl. ..... 4/546; 4/547; 5/90

[58] Field of Search ..... 4/547, 546, 538, 542, 4/549, 561, 559, 562, 564, 565, 571, 585, 443; 5/60, 62, 90, 81 R

[56] References Cited

U.S. PATENT DOCUMENTS

| | | | |
|---|---|---|---|
| 2,850,743 | 9/1958 | White | 4/564 |
| 3,943,583 | 3/1976 | Ishikawa | 5/90 |
| 4,233,694 | 11/1980 | Janosko et al. | 4/542 |
| 4,407,029 | 10/1983 | Schmidt | 4/564 |
| 4,558,473 | 12/1985 | Morikawa et al. | 4/443 X |
| 4,571,759 | 2/1986 | Sasaki et al. | 5/90 |
| 4,631,762 | 12/1986 | Fugett | 5/90 |
| 4,754,508 | 7/1988 | Nishiguchi | 5/90 |
| 4,761,837 | 8/1988 | Takada | 4/443 |
| 4,910,816 | 3/1990 | Lansing | 5/90 |

*Primary Examiner*—Henry J. Recla
*Assistant Examiner*—Robert M. Fetsuga
*Attorney, Agent, or Firm*—Armstrong, Nikaido, Marmelstein, Kubovcik & Murray

[57] ABSTRACT

A bed capable of allowing a patient such as the aged confined in a bed to take a bath easily and without much trouble to a nurse attending to the patient. According to a feature of the bed, a bath-tub is slidably mounted at the lower portion of the bed, the bath-tub having a mat disposed therein, said mat being movable up and down within the bath-tub with a human body laid thereon. The bed is provided with a tilting mechanism for easily transferring a patient from the bed to the mat, the mat also capable of being tilted by a suitable mechanism so that the human body may be easily transferred from the mat to the bed.

16 Claims, 19 Drawing Sheets

BED WITH A BATH-TUB

BACKGROUND OF THE INVENTION

This invention relates to a bed in which a patient such as an aged confined to a bed can take a bath without much troubling a nurse, and a bed in which a patient can open his bowels by his own operation without emiting an offensive smell in to the room.

PRIOR ART AND PROBLEMS

The average span of life of the Japanese keeps extending year by year, and Japan now enjoys the most long life society in the world. However, the presence of the aged confined to bed poses a social problem in that unendurable burden and pain are daily imposed on both nurse and the aged. Among them, taking a bath is the most burdensome operation, and an unskilled nurse often fails to sufficiently help a patient take a bath. For this reason, merely wiping and cleaning the body are resorted to instead of taking a bath since this can be done safely in home. However, with such wiping and cleaning, it is difficult to obtain the same effect as taking a bath. As a result, the dirt of a patient is accumulated, and his muscles, blood vessels, nerves or the like become atrophied, exhibiting a degenerated pheonomenon. Particularly, contamination of the intimate parts of the body is significant.

Furthermore, it is extremely difficult for the aged confined to a bed to relieve themselves. In view of this problem, various types of beds have been developed wherein one can relieve himself on the bed. However, use of these beds unavoidably involves emission of an offensive smell into the room, which fail to relieve the mental pain of the patient in deference thereto.

SUMMARY OF THE INVENTION

It is therefore an object of this invention to provide a bed with a bath-tub which can cause even an unskilled nurse to allow the aged in bed to take a bath easily and safely.

It is a further object of this invention to provide a bed with a bath-tub provided with an apparatus by which a patient can open the bowels by his own operation without emitting an offensive smell into the room.

It is another object of this invention to provide a bed with a bath-tub provided with a bath-tub which can decompose, insolubilize, deodor and remove urine and feces even in cases of incontinence of the patient.

Other objects and advantages of this invention will become apparent from a reading of the ensuing description in connection with the accompanying drawings.

BRIEF DESCRIPTION OF THE DRAWINGS

FIG. 10(*b*) is a partly cutaway perspective view of a movable toilet bowl according to the present invention;

DETAILED DESCRIPTION OF THE PREFERRED EMBODIMENTS OF THE INVENTION

The present invention is characterized in that a bath-tub is horizontally slidably mounted on the lower portion of a floor of a bed, said bath-tub having a mat disposed to be movable up and down within the bath-tub, said bed being provided with a tilting means used to easily transfer a patient from the bed to the mat, said mat being tiltable so that the patient after bathing may be transferred easily from the mat to the bed.

The present invention is further characterized in that a bed and a bath-tub are horizontally slidably mounted, said bath-tub having a movable mat disposed thereon, said movable mat being movable up and down within the bath-tub with a patient laid thereon, said movable mat being designed so that a convex portion provided in the lower surface of the movable mat is fitted into a frame having a guide rail provided short-lengthwise so as to be horizontally reciprocated to and from the bed with a patient laid thereon.

The present invention is still further characterized in that a partitioning mat is made movable so as to form an opening in the vicinity of a central portion of a bed, a toilet bowl is vertically movably fixed to said opening, said toilet bowl comprising a bubble injecting pipe which functions as an anti-odor, a hot water nozzle for cleaning the whole anus and a hot air nozzle for drying the whole anus.

Embodiments of the present invention will be described hereinafter with reference to the drawings.

Figure 1:
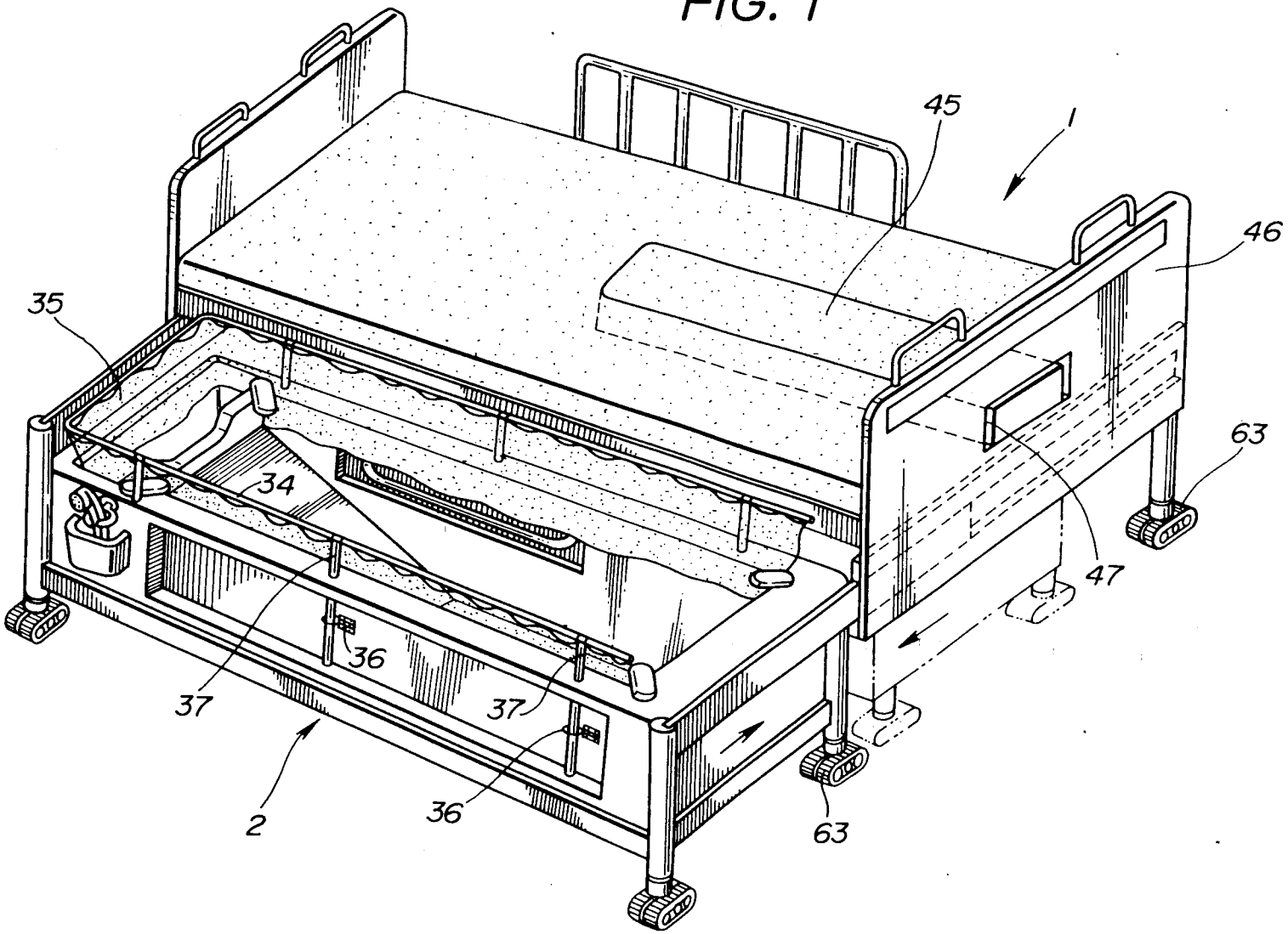
FIG. 1 is a perspective view showing an embodiment of the present invention.

FIG. 1 is a perspective view showing an embodiment of the present invention, illustrates an example in which a bed 1 and a bath-tub 2 are horizontally slidably mounted, the bath tub 2 having a mat 3 (not shown) disposed therein, the mat 3 being movable up and down within the bath-tub with a patient laying thereon.

Figure 2:
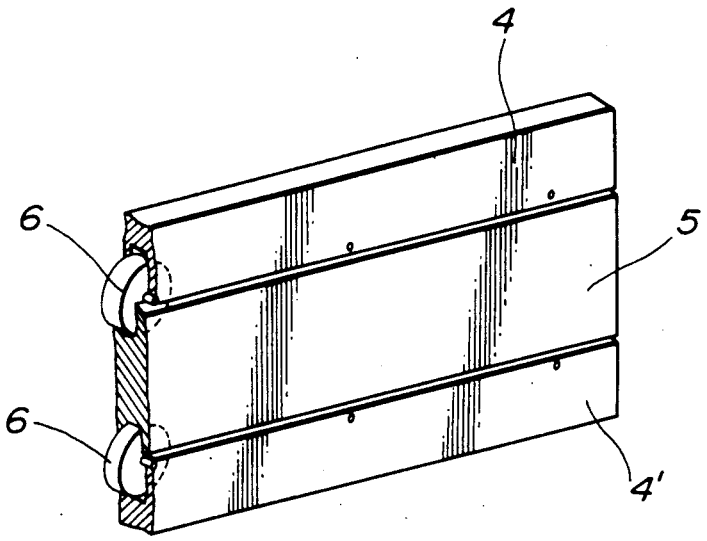
FIG. 2 is a perspective view showing a connected state of a bed and a bath-tub.
Figure 4:
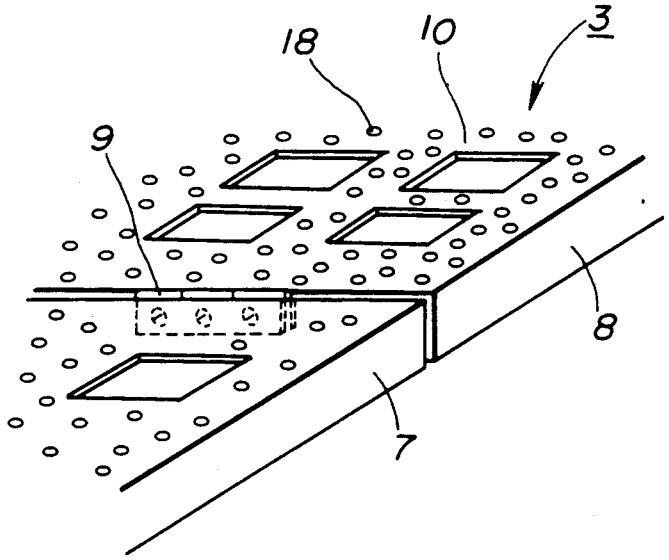
FIG. 4 is a partial perspective view of a mat according to the present invention.

In the bed 1 and the bath-tub 2 as shown in FIG. 2, a guide member 5 opposed short-lengthwise or extending along the width of the bath tub is fitted in guide rails 4, 4' formed on inner surfaces of both side plates of a bed head portion and a bed foot portion. The upper and lower sliding surfaces of the guide rails are formed having concave portions in to which a plurality of wheels 6 are fixed. Concave portions formed in the upper and lower surfaces of the guide member 5 are fitted into and come into contact with the wheels 6 so that the bed and the bath-tub may be easily slid relative to each other.

As shown in FIGS. 3 to 6, the mat comprises two frames 7 and 8 which are connected by a hinge 9, and a latticelike mat cloth 10 is mounted on the frames. The material for the mat cloth 10 is preferably a soft material which has been subjected to surface treatment which is smooth and has no resistance even when the skin surface of the patient rubs thereon, for example, fabric with velvet-like material electrostatically planted. The mat cloth 10 is bored with a number of through-holes 18 so as to generate supersonic waves caused by a heating and circulating device and to allow bubbles for massaging the skin surfaces to pass through through-holes so as to spread all over the body thereon.

Figure 3:
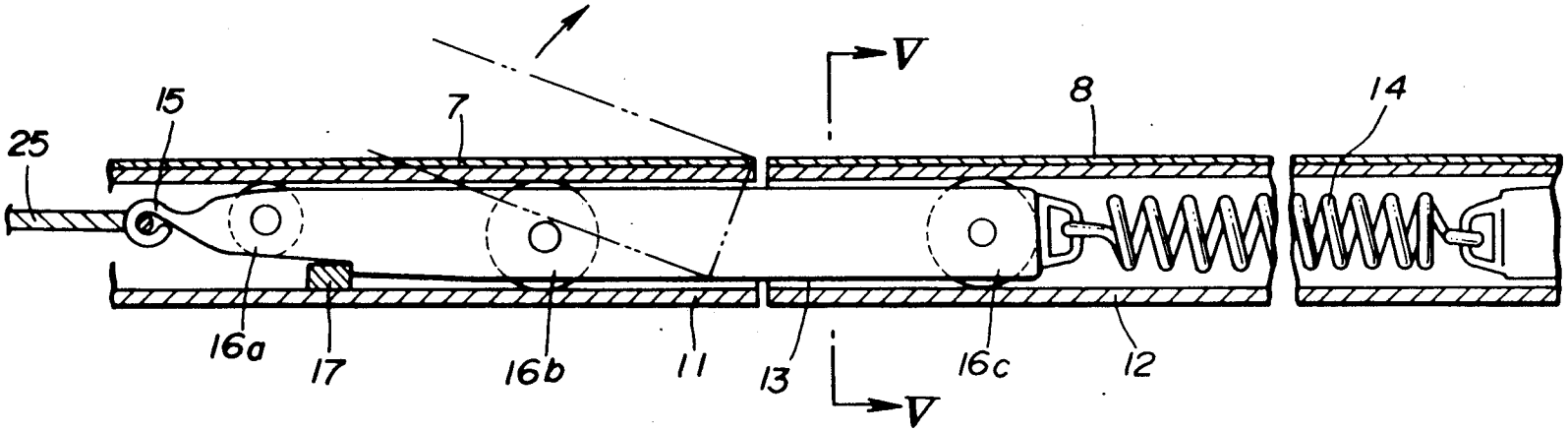
FIG. 3 is a sectional view showing a bending mechanism of a mat according to the present invention.
Figure 5:
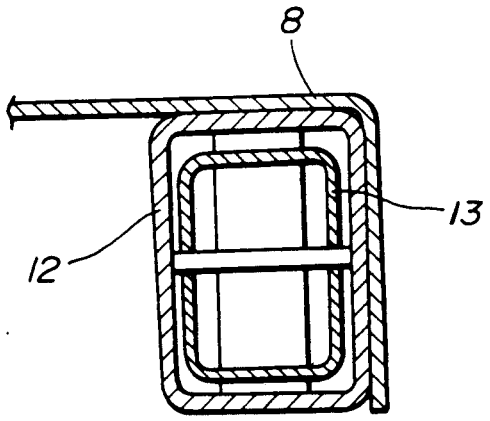
FIG. 5 is a sectional view taken on line V—V of FIG. 3.

As shown in FIGS. 3 and 5, tubular bodies 11 and 12 for bending or extending the mat are secured to both sides of the frame. A movable tubular body 13 is fitted into the tubular body, the movable tubular body having a rear end connected by a spring 14, and a hook 15 for engaging a rope secured to the extreme end thereof. Wheels 16*a*, 16*b* and 16*c* are secured to the front, rear and central portions respectively of the movable tubular body 13, and these wheels come into abutment with the tubular body to faciliate the movement of the tubular body. In the figures, reference numeral 17 designates a stop having a function of raising a gradient at the extreme end of the movable tubular body 13 so that the extreme end of the movable tubular body is stopped at that position.

Figure 7:
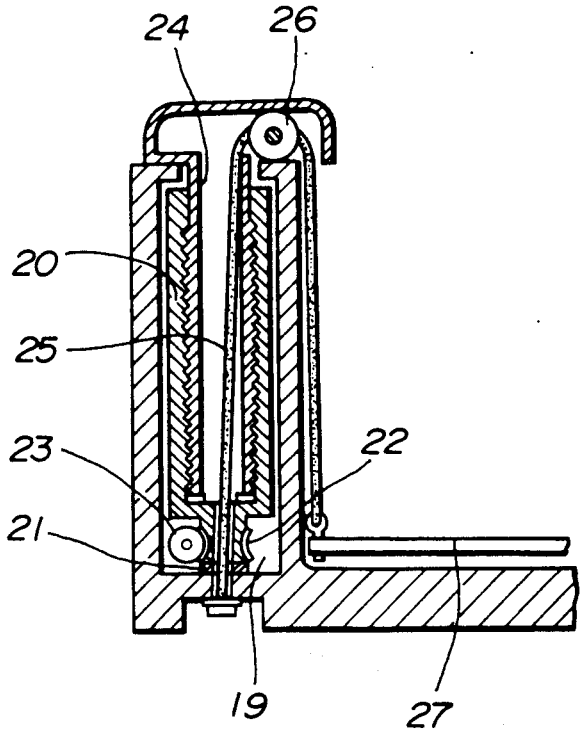
FIG. 7 is a sectional view showing an elevating device for a mat.

As shown in FIG. 7, cylindrical recesses 19 are formed in four corners of the bath-tub. A cylindrical member 20 with a lower end thereof formed to have a small diameter and with an inner peripheral surface thereof formed with threads is fitted into the recess 19. The bottom of the cylindrical member 20 rotatably comes into abutment with the lower surface of the cylindrical recess through a ball bearing 21. A small diameter outer peripheral surface at the lower end of the cylindrical member 20 is formed into an arclike recess 22 with threads formed therein, said threads being engaged with a driving gear 23. The driving gear is connected to a driving shaft of a motor (not shown) when the mat is automatically moved up and down, and is connected to a manual handle (not shown) when the mat is manually moved up and down. The cylindrical member 20 is internally threaded and provided with an elevating device 24 with external threads formed at the extreme end. A rope 25 connected at one end to the mat is inserted into a cavity of the elevating device while being guided by a roller 26. The extreme end of this rope 25 extends through the small diameter portion of the cylindrical member 20 and the lower surface of the cylindrical recess and is secured to the lower surface of the corner of the bath-tub. The rope 25 is attached to the bath-tub by fitting and securing an element with threads formed in the outer peripheral surface thereof to the extreme end of the rope and threadedly engaging a nut with the element. With this arrangement, when the driving gear 23 is rotated, cylindrical member 20 rotates causing the elevating devices 24, 24' to move up and down and at the same time causing the mat to move up and down.

Figure 8:
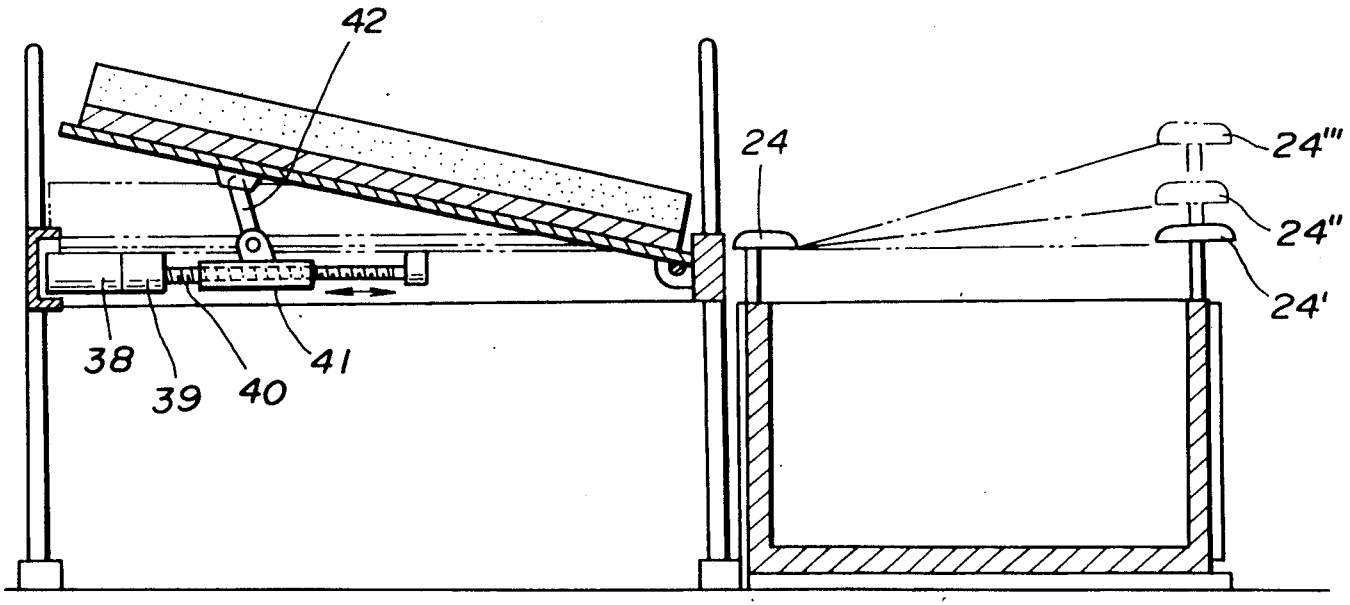
FIGS. 8 and 9 are respectively sectional views showing an inclining mechanism for a patient from a bed toward a bath-tub.

In order to transfer a patient from the bath-tub to the bed, all the elevating devices are moved up so the mat is at the level of the bed, and the elevating device 24' located remote from the bed is moved upwardly at 24', 24'' until a suitable inclination is achieved after which the patient is rolled and transferred to the bed, as shown in FIG. 8.

Figure 6:
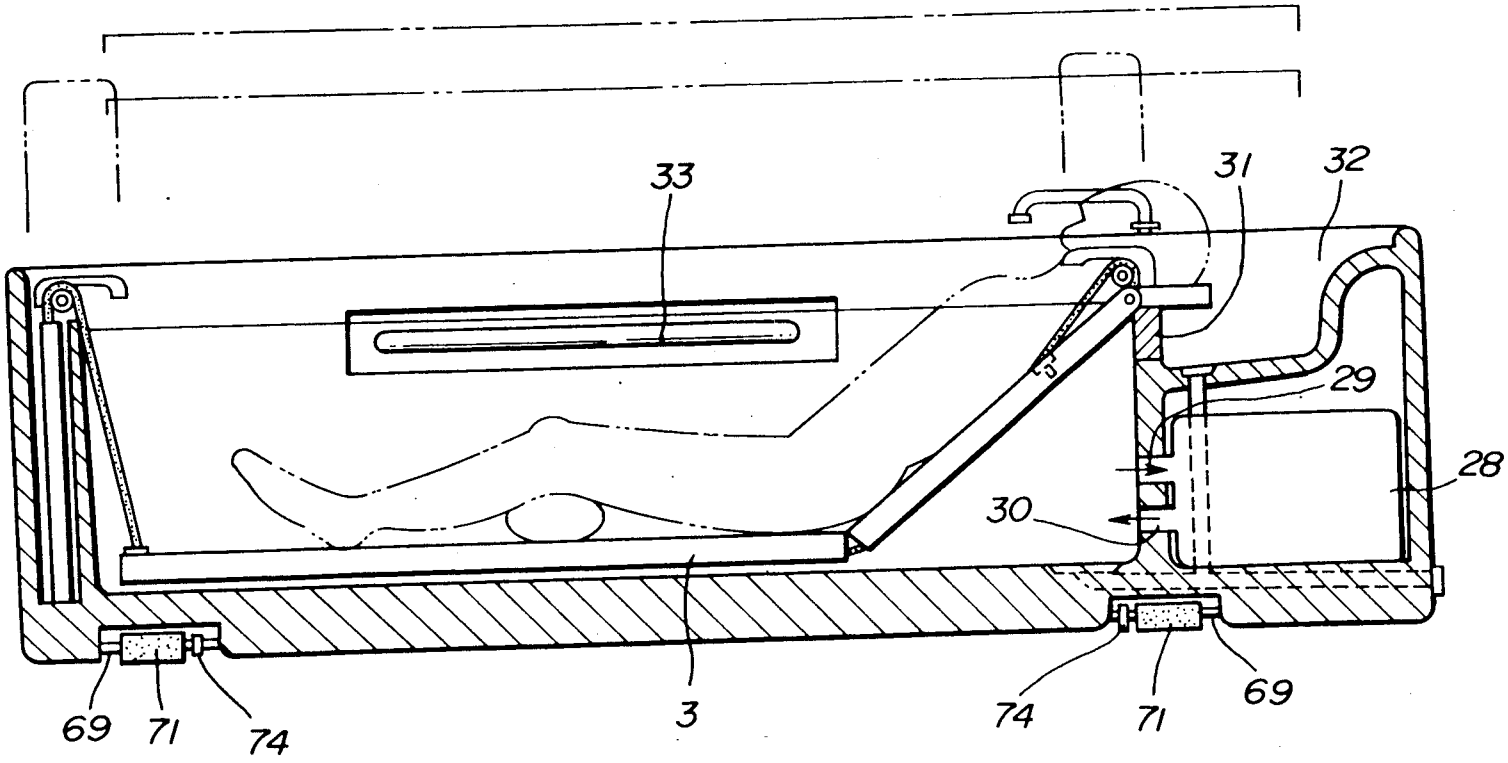
FIG. 6 is a sectional view showing the bathing state of a patient in a bath-tub according to the present invention.

The bath-tub according to the present invention is provided with an apparatus 28 for heating and circulating bath water in which one may take a bath any time every day without exchanging the bath water and the body is cleaned by merely remaining in the bath-tub. That is, as shown in FIG. 6, bath water is guided to the heating and circulating apparatus 28 through an intake pipe 29, and the filtered and heated bath water is injected into the bath-tub along with bubbles caused by a supersonic nozzle from a jet pipe 30.

The heating, circulating and cleaning apparatus 28 for bath water comprises detachable filter means for pumping bath water up from the bath-tub to filter it, means for heating the pumped up bath water, a temperature sensor for controlling said heating means, and means for injecting the filtered and heated bath water into the bath-tub along with bubbles caused by the supersonic nozzle. A mineral agent for purifying bath water is mixed into the bath water, said mineral agent having the functions of separation, agglomeration and sterilization of organic matter, odor-prevention, and suppressing the generation of steam. The mixing of the bath water purifying mineral agent into the bath-tub according to the present invention constitutes one of features of the present invention. In this manner, the bath water purifying mineral agent mixed into the bath water thereby suppresses generation of steam and generation of odor, and as a consequence of which, the bath-tub can be slidably mounted on the bed.

The bath water purifying mineral agents used include acidic additives containing a variety of metal salts and non-metal salts as a main constituent which are obtained by dissolving vermiculite resulting from weathered mica group mineral (preferably black mica) or an earth resulting from further weathered vermiculite into an inorganic acid (for example, sulfuric acid and hydrochloric acid) aqueous solution. This additives may simultaneously attain the separation and removal of organic matter dissolved in the bath water, sterilization, replenishment of minerals, and agglomeration and removal of insoluble matter.

Furthermore, if the patient in the bath-tub should discharge feces or urine while in the bath water, the organic matter is decomposed, insolubilized and deodored by the action of the bath water purifying mineral agent, and the resulant insoluble matter is filtered and removed by the filter portion of the heating and circulating device 28. Accordingly, in the above case, the bath water is automatically purified without exchanging it, which without saying provides an excellent effect in the use of the bath-tub by patients.

Figure 12:
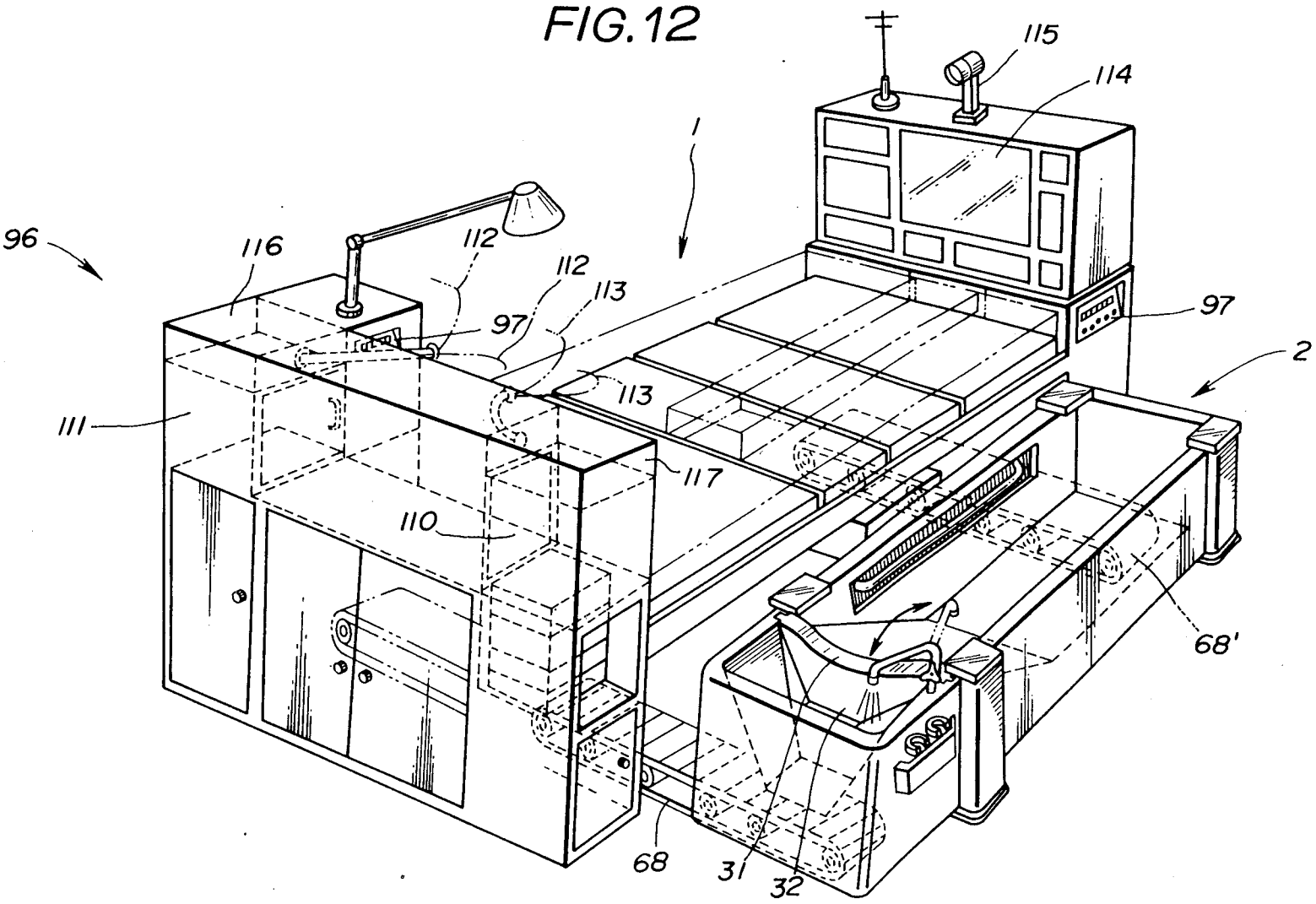
FIG. 12 is a perspective view showing another embodiment of a bed according to the present invention.

As shown in FIGS. 6 and 12, a weir 31 is detachably fitted in the bath-tub so as to form a hair washing chamber 32. In FIGS. 1 and 6, reference numeral 33 designates a gripping rod attached to the recess on the both sides of the bath-tub so that the patient may grasp the rod to stabilize his body.

As shown in FIG. 1, the bath-tub may be provided with a cover in which a vinyl curtain 35 extends from an inverted U-shaped curtain rail 34 connected to the upper end of an elevating rod 37 so that the extreme lower end of the curtain is positioned within the bath-tub. This elevating rod 37 extends through a ring 36 of a stop ring secured substantially in the intermediate position of the bath tub and at its lower end is fitted movably up and down in the bath-tub. The elevating rod 37 is locked at a suitable position by pushing down the stop ring 36. This cover is convenient in helping to prevent hot water from being scattered when the patient moves out of the bath-tub and takes a shower on the mat.

Figure 9:
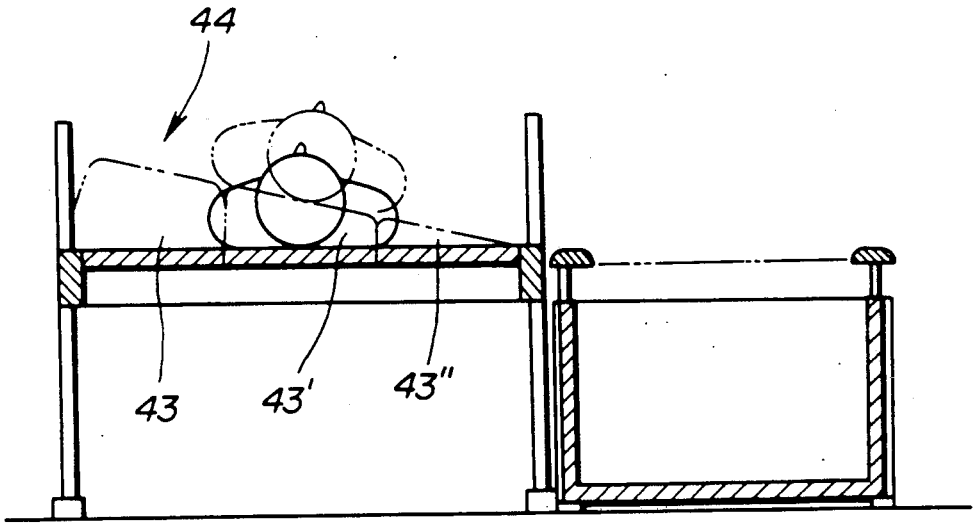

Referring now to FIG. 8 in order to transfer a patient from the bed to the mat in the bath-tub, a threaded rod 40 is rotated by a motor 38 through a reduction gear 39, and a threaded movable tubular body 41 which engages the threaded rod 40 is moved such that a push-up rod 42 mounted on the movable tubular body 41 is caused to stand upright. Alternatively, as shown in FIG. 9, a rolling mat 44 with cylindrical air bags 43, 43' and 43" disposed thereon is laid so that when air is fed under pressure to the bags, the mat is inclined in a rolling direction.

The bed of the present invention is further provided with an evacuation device capable of forming an opening substantially in the central portion of the bed by moving a partitioning mat 45. This partitioning mat may be slid a fixed distance automatically or manually from an opening 47 formed in a foot board 46 as shown in FIG. 1.

Figure 10A:
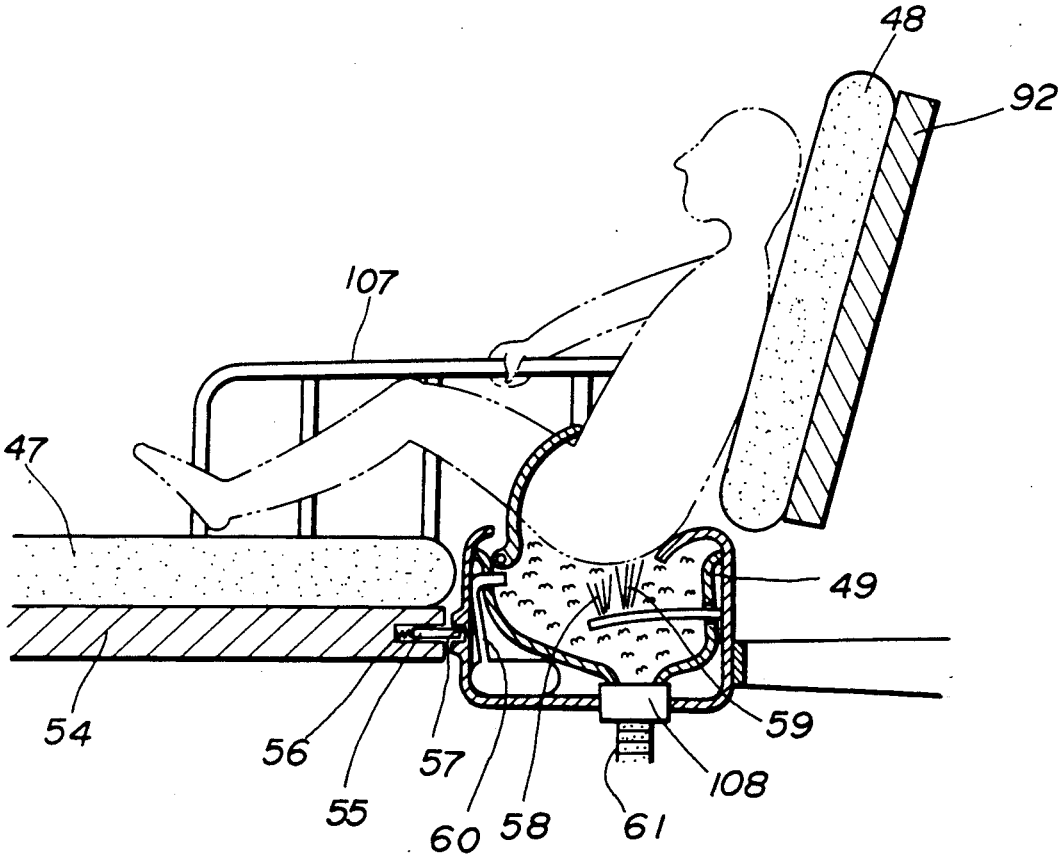
FIG. 10(*a*) is a sectional view showing a movable toilet bowl.
Figure 10B:
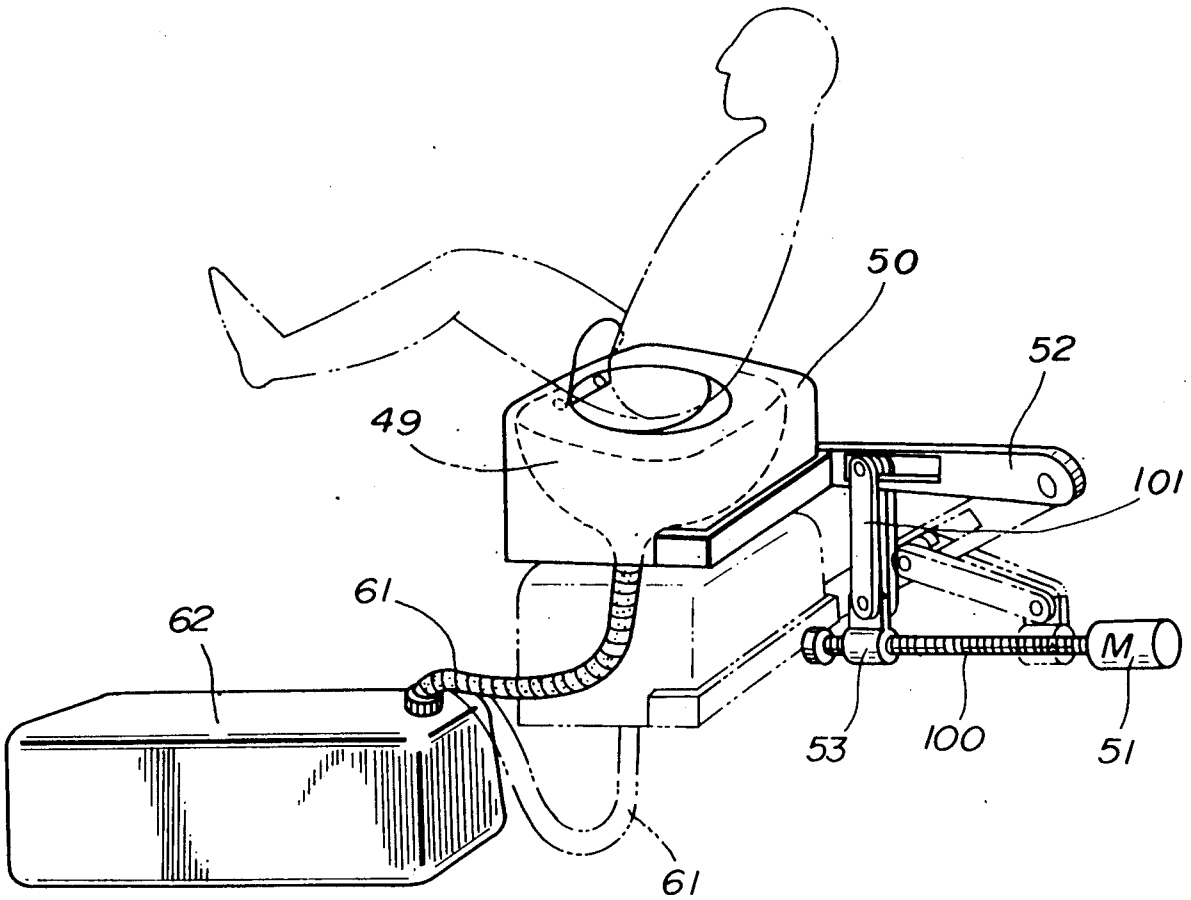

A vertically movable toilet bowl is provided in the opening which can be operated manually or with known means, by way of a motor. As shown in FIG. 10(*a*), when the partitioning mat 47 is moved and at the same time an upper mat 48 is moved upward and inclined at a predetermined angle by upwardly moving and inclining a base plate 92 so that the patient is in a position to easily relieve himself. The upper mat 48 may be moved upward and inclined in a manner similar to that when the push-up rod shown in FIG. 8 is caused to stand upright. A toilet bowl 49 is encased in a box 50 capable of supporting the patient and disposed so that the bowl may be moved up and down along with the box 50 by means of an arm 52 driven by a motor 51 as shown in FIG. 10(*b*). The arm 52 may be driven by rotating a threaded rod 100 by a motor 51 which moves a threaded movable tubular body 53 engaged with the threaded rod 100, thereby standing upright the rod 101 secured to the movable tubular body 53 and consequently moving the arm 52. Thus elevated toilet bowl 49 is fitted in a recess 57 formed in the box by engaging a stopper 55 secured in a hole in the base plate 54, and movable in and out of a base plate 54 against the force of a spring 56 and when the pressing is released, by virtue of the force of the spring 56. In the figure, reference numeral 107 designates a handrail secured on both sides of the bed for the patient to hold during evacuation in the toilet bowl.

The toilet bowl is provided with a hot water nozzle 58 for cleaning the whole anus of a patient, a hot air nozzle 59 for drying the whole anus, the nozzle being formed integral with the hot water nozzle, a bubble injecting pipe 60 serving as an anti-odor means, and a vaccum device 108. In use, when the patient relieves himself, bubbles 102 for anti-odor purposes are injected, and the patient evacuates therein thereby contacting the feces with the bubbles. The feces embraced by the bubbles after evacuation are immediately stored in a vacuum tank 62 by first passing through a flexible vacuum pipe 61. In this manner, the feces are made free from odor by the bubbles and stored along with flushing water in the sealed vacuum tank 62. Therefore, it is possible to prevent emission of odors thereabout, prevent rebounding of the feces and prevent adhesion of the feces to the toilet bowl due to the lubricating effect of the bubbles.

When the toilet bowl is provided in the bed as described above, even the aged confined in bed can relieve himself unaided or with a little aid. Therefore, not only are the duties of a nurse relieved but an improved mental state such as peace of mind for the patient himself is achieved.

In the above-described embodiment, the other end of the hot water nozzle 58 is connected to the aforesaid bath water heating, circulating and purifying device. With this arrangement, suitably heated water can be injected into the toilet bowl merely by turning a cock of the nozzle. Therefore, this device can be constructed very inexpensively and in addition, odorless feces can be further completely attained by the deodorizing action of the bath water purifying mineral agent.

After completion of evacuation, the toilet bowl 49 moves down together with the box 50, and as the upper mat 48 moves down, the partitioning mat 47 returns to its original position on the upper surface of the bowl and assumes its original horizontal state.

Figure 11:
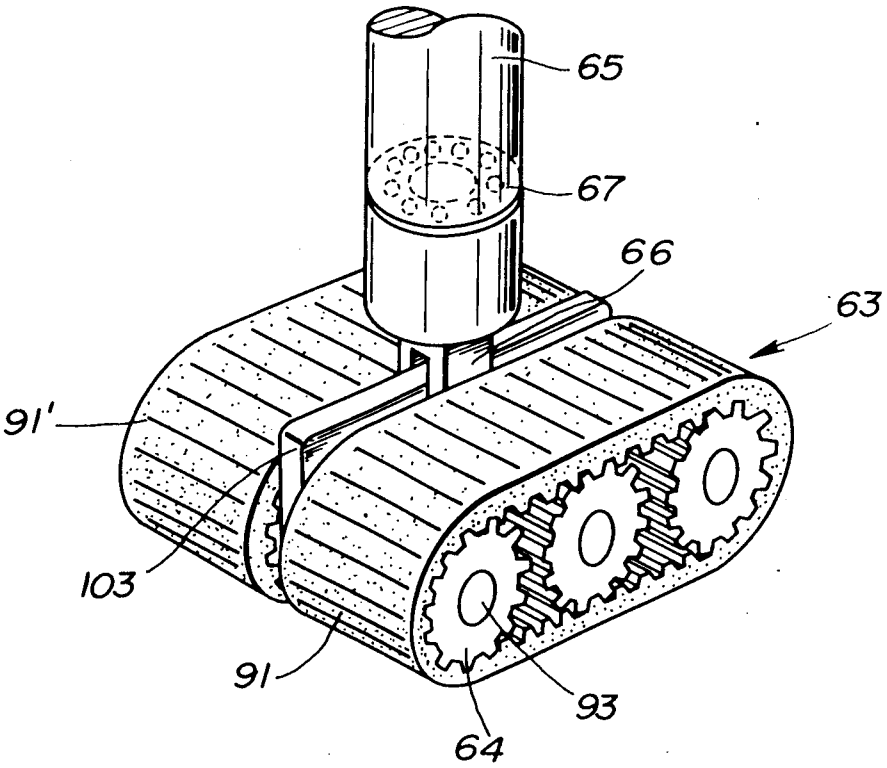
FIG. 11 is a perspective view showing a leg wheel of the bed shown in FIG. 1.

The bed has a leg portion to which a leg wheel 63 is mounted as is shown in FIG. 11. Leg wheel 63 includes three structures in the shape of wheels 64 each formed in two cylidrical outer peripheral surfaces having concavo-convex portions and closely fitted into shafts 93 arranged in a parallel spaced relation. The three shafts 93 are fitted into notches at the lower end of a connecting plate 103. Leg wheel 63 further includes connected, endless belts 91, 91' formed with concavo-convex portions meshed with concavo-convex portions of the wheels 64 and extends over the wheels 64 spaced from the connecting plate. A leg portion 65 of the bed is connected to an intermediate portion of the connecting plate 103. The leg portion 65 is connected to the connecting plate 103 by a split leg end 66 and secured by a pin. Reference numeral 67 denotes a ball bearing for rotatably connecting the bed leg. With the leg wheel 63 constructed as described above, even if the bed placed on a tatami (a mat) and then moved, the tatami is not prone to be scratched, and the bed can be easily moved in the desired direction.

FIG. 12 shows another embodiment of the present invention illustrating an example in which a bed 1 and a bath-tub 2 are slidable relative to each other by caterpillars 68, 68' secured to both sides of the lower surface of the bath-tub.

Figure 13:
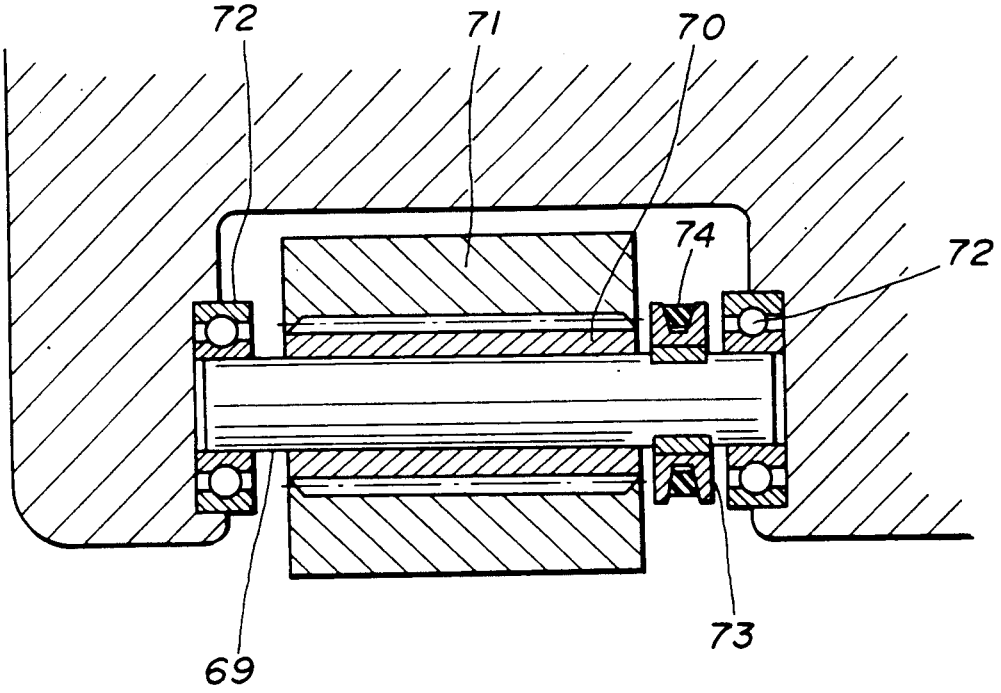
FIG. 13 is a sectional view showing a catapillar of the bed shown in FIG. 12.

Each caterpillar 68 comprises, as shown in FIGS. 6, 12 and 13, a number of spaced apart cylindrical rollers 69, an endless belt 71 extended over the rollers 69, a ball bearing 72 for supporting opposite ends of the roller 69, and a V-belt 74 wound on a V-shaped grooved wheel 73 secured to the shaft of each roller. A gear 70 is secured to the outer peripheral surface of the roller, the gear 70 being meshed with concavo-convex portions formed in the inner peripheral surface of the endless belt. The V-belt 74 is rotated by a motor and the endless belt 71 is driven through the roller. The roller has a part which slides freely without being locked.

By employment of the caterpillar system, when the bed is placed on a tatami and the bath-tub is slidably moved or bed is moved, they can be moved smoothly. Therefore, hot water does not overflow, and the floor surface such as tatami is will not be scratched and the bed can be easily moved in the desired direction.

Figure 14:
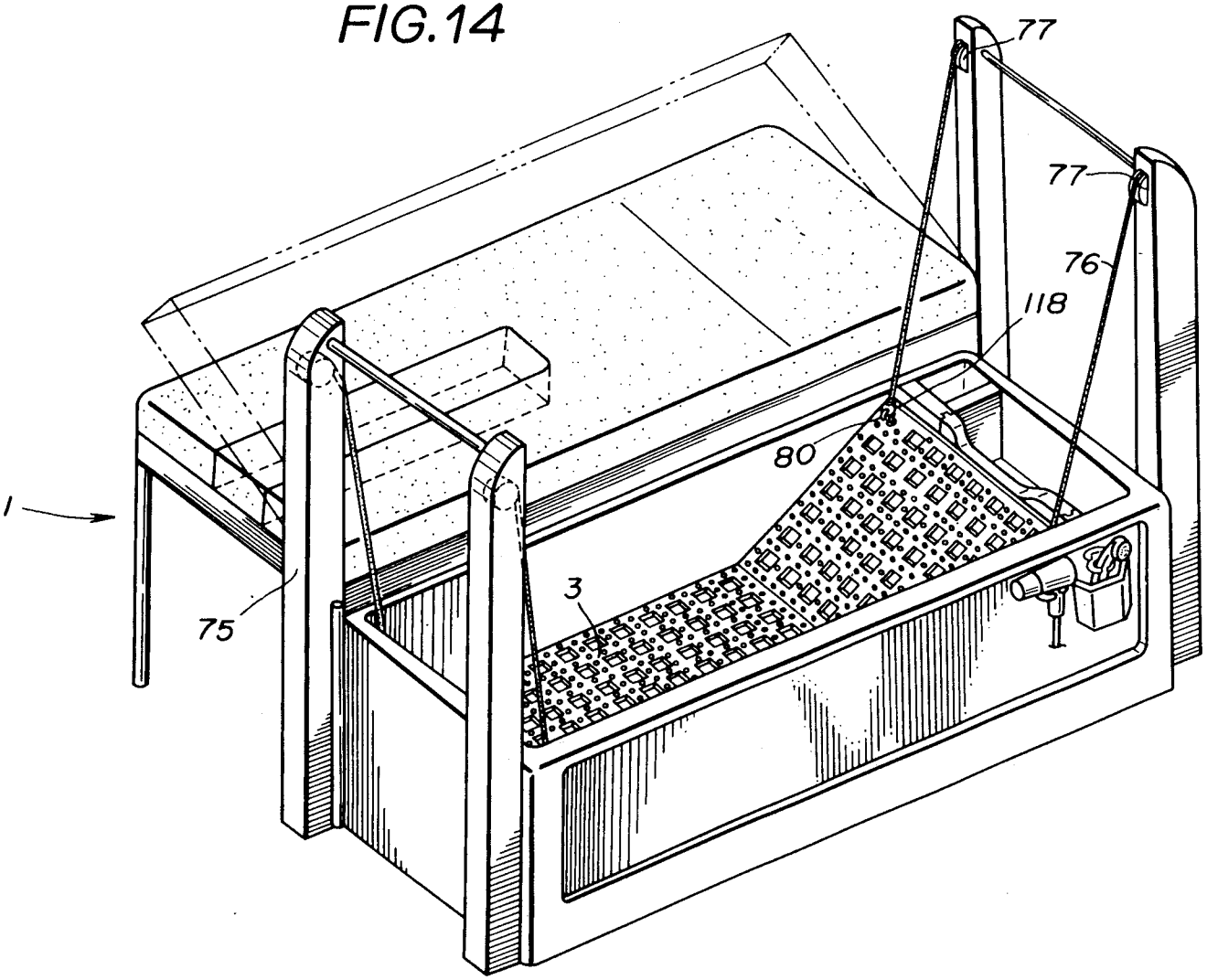
FIG. 14 is a perspective view showing still another embodiment of the bed according to the present invention.
Figure 15:
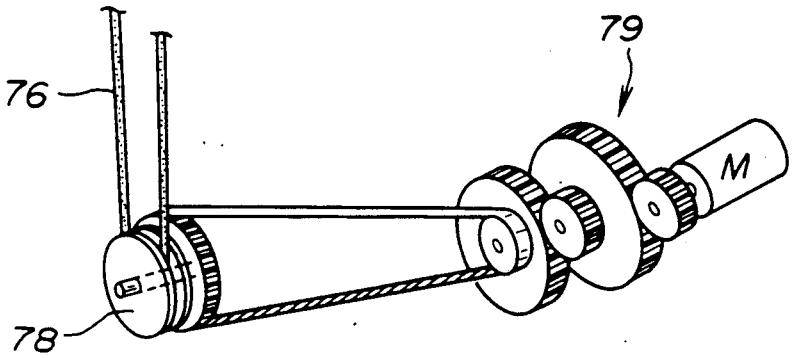
FIG. 15 is a perspective view showing an elevating mechanism for the bed shown in FIG. 14.

FIG. 14 shows another embodiment of the present invention in which the bed 1 and the bath-tub are slidably moved by moving the bed leaving posts 75 at the four corners of the bath-tub.

In the above-described embodiment, the mat 3 is moved up and down by hanging down a plastic rope 76 connected to the four corners of the bed through rollers 77 secured to the upper end of four corners of the bath-tub and winding or unwinding the rope 76 by means of a drum 78 as shown in FIG. 5. The winding or unwinding the drum 78 may be accomplished by means of a motor or manually through a group of reduction gears 79. The mat 3 and the rope 76 are connected by locking hook-like devices 80 to four corners of the mat, and engaging the hook-like devices 80 with flying rings 118 formed at the end of the plastic rope.

Figure 18:
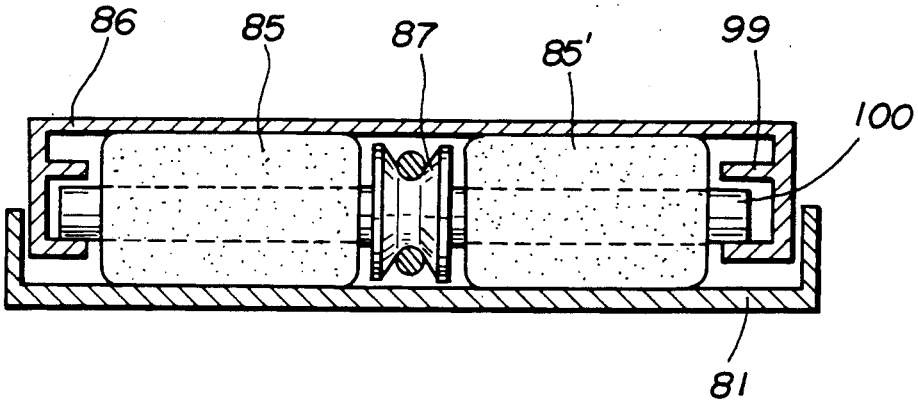
FIG. 18 is a sectional view showing a state in which a convex portion in the lower surface of the movable mat is fitted into a guide rail.
Figure 16:
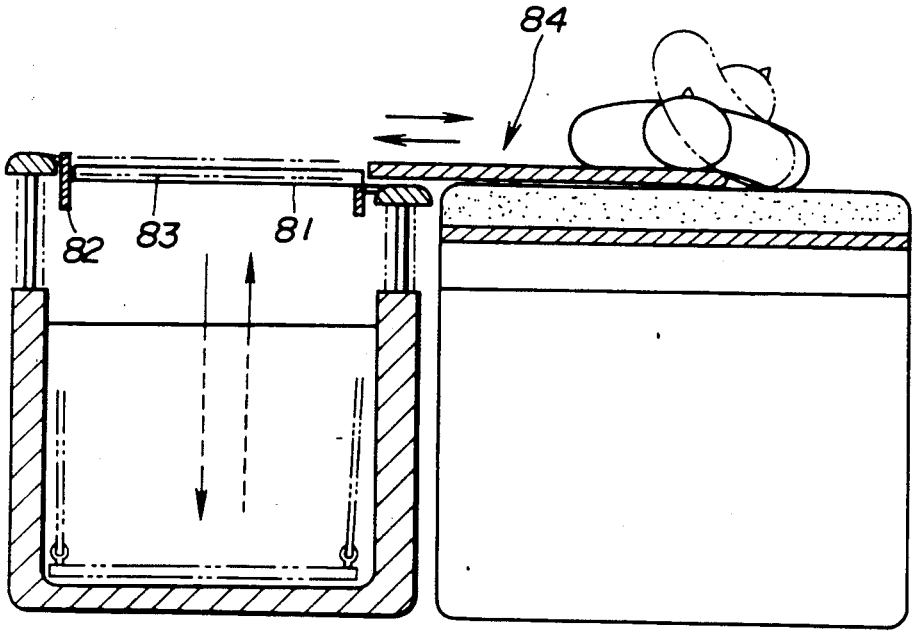
FIG. 16 is a sectional view showing another embodiment of a bed according to the present invention.

FIGS. 16 and 18 show another embodiment of the present invention which illustrates an example in which a convex portion 83 provided on the lower surface of a movable mat 84 is fitted in a frame body 82 provided with a guide rail 81 along the width of the bath-tub so that the movable mat 84 may be reciprocated in the direction of the bed.

The convex portion in the lower surface of the movable mat 84 is designed so that as shown in FIG. 18, a V-shaped grooved wheel 87 can be fitted into a central portion of a shaft 100, and a number of paired wheels with rollers 85, 85' fitted at both ends are supported on the lower surface of the frame 86 with opposite ends of the shaft being supported by the bearing 99 formed on the frame 86. A soft cloth 94 is laid on the upper surface of the frame 86.

The movable mat 84 can be moved by a rope 90 wound on the pulley 89 driven by the motor 88. The rope 90 has one end secured to the frame 82 and extends to the upper groove portion of the V-shaped grooved wheel 87 in the intermediary of the roller passing the V-shaped grooved wheel 87. The rope 90 returns from the lower groove portion of the V-shaped grooved wheel 87, passes over the pulley 95 secured to the bath-tub, passes about the pulley 89 driven by the motor and is secured at end 104 to the mat. Accordingly, when the pulley 89 is rotated by the motor 88 to move the rope 90 in a direction as indicated by arrows, the mat is moved in the direction of the bed. When rotation of the pulley 89 is reversed, the rope 90 is moved in the direction opposite to the arrow and the mat is moved in the direction of the bath-tub. The pulley 95 is formed with two grooves, one groove guiding a rope secured to the frame 82 while the other groove guiding a rope secured to the end 104 of the movable mat. The pulleys 95 and 89 are secured to the bath-tub through by shafts 105 and 106.

Figure 17A:
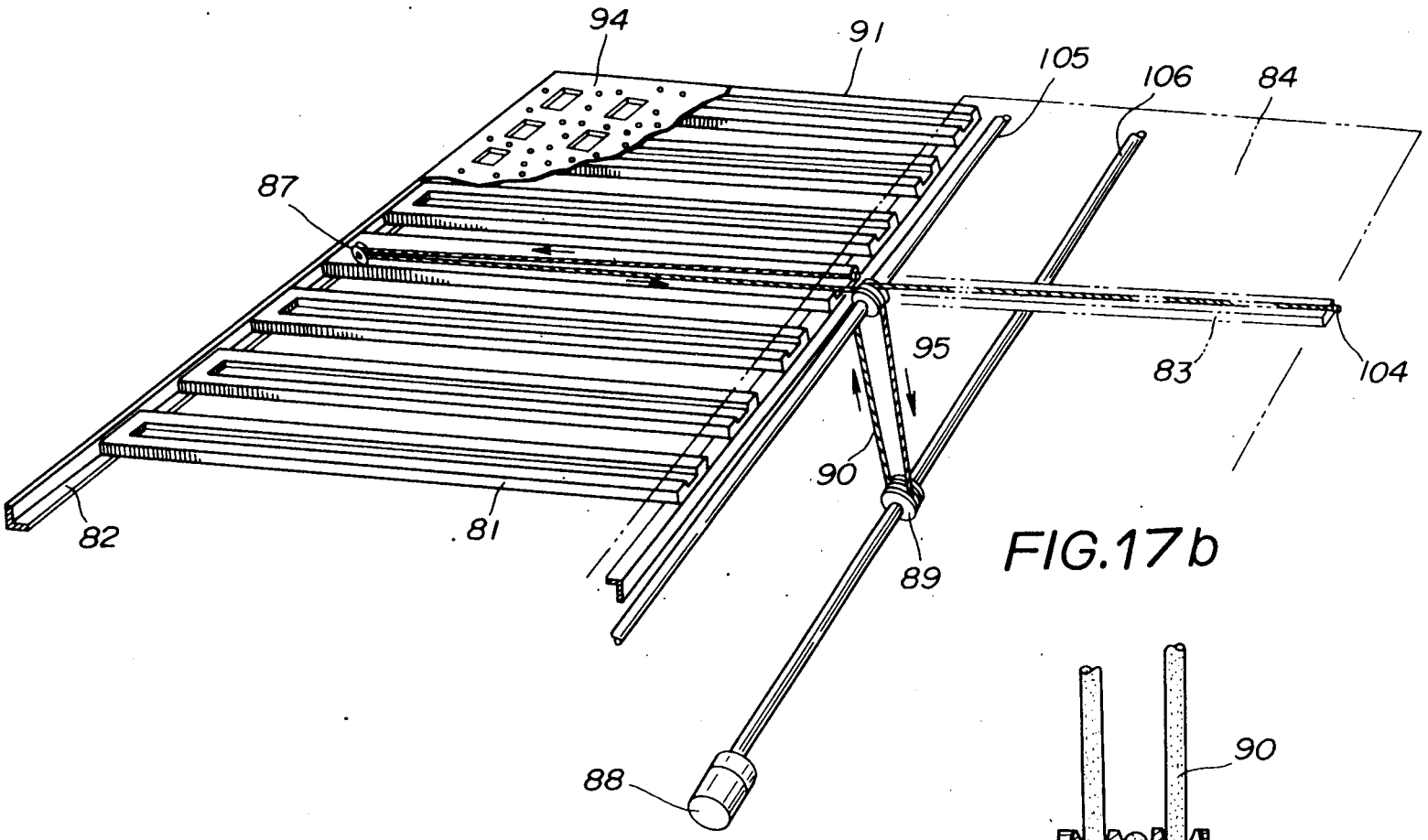
FIG. 17(*a*) is a perspective view showing a moving mechanism for a movable mat showing in FIG. 16, and FIG. 17(*b*) is an enlarged view of a pulley for winding and unwinding a rope.
Figure 17B:
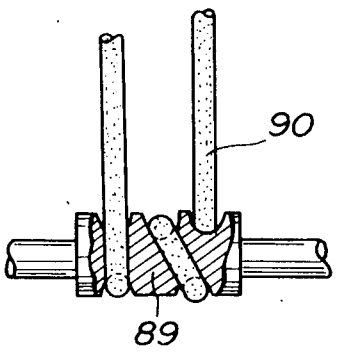

FIG. 17(*a*) merely shows the one convex portion in the lower surface of the movable mat being moved by the rope for a clearer explanation of the driving principle of the movable mat. In actual practice, however, similar convex portions are fitted in a number of guide rails 81 for similar movement.

Figure 19:
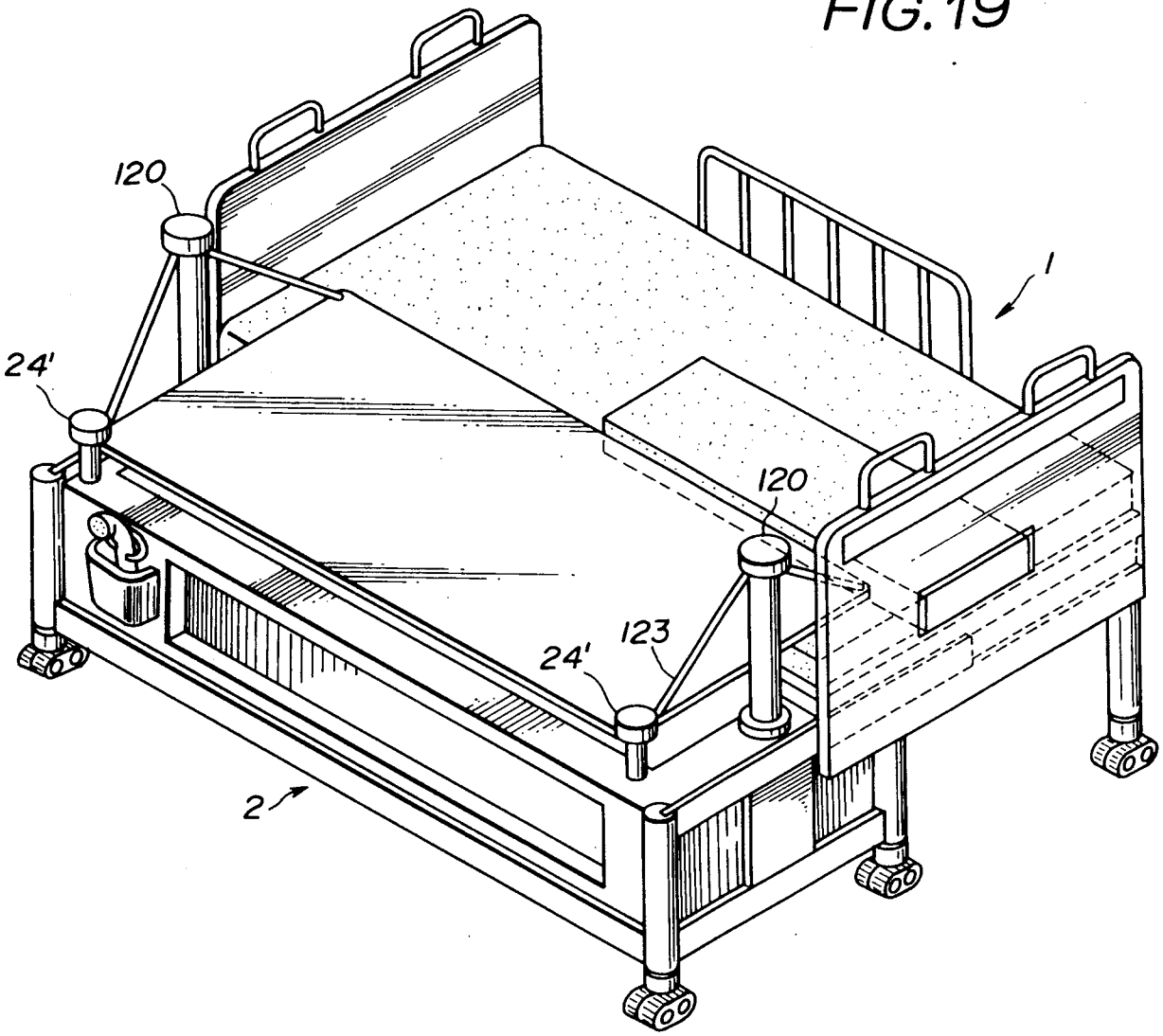
FIG. 19 is a perspective view showing another embodiment according to the present invention.
Figure 20:
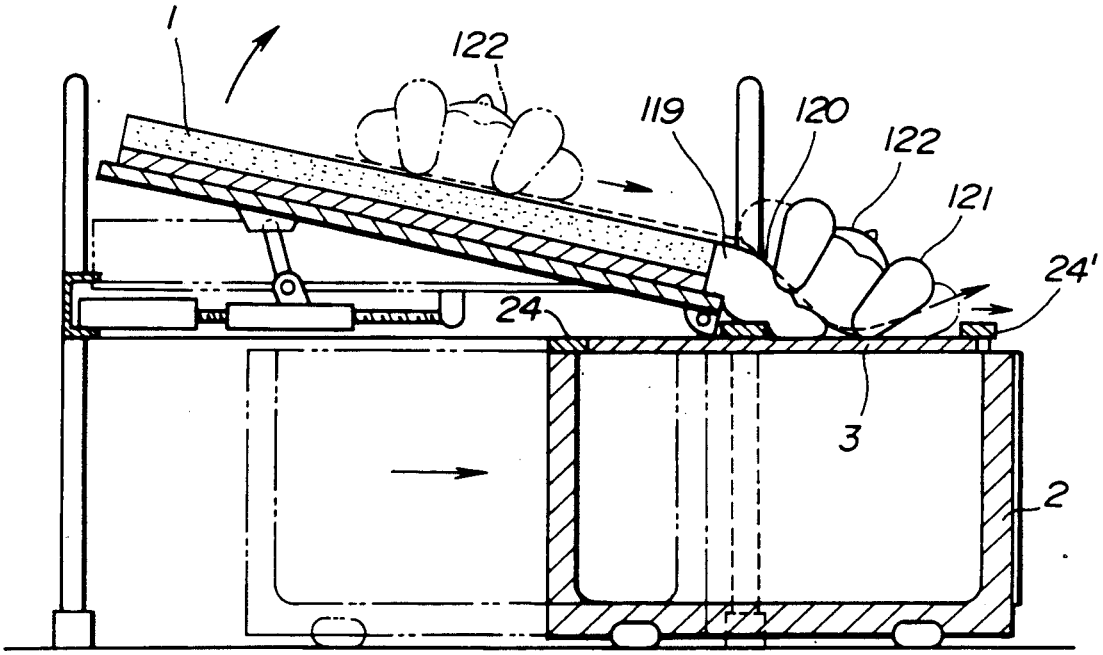
FIG. 20 is a sectional view showing the transfer of a patient for bathing purpose in a bath-tub which uses the bed shown in FIG. 19.
Figure 21:
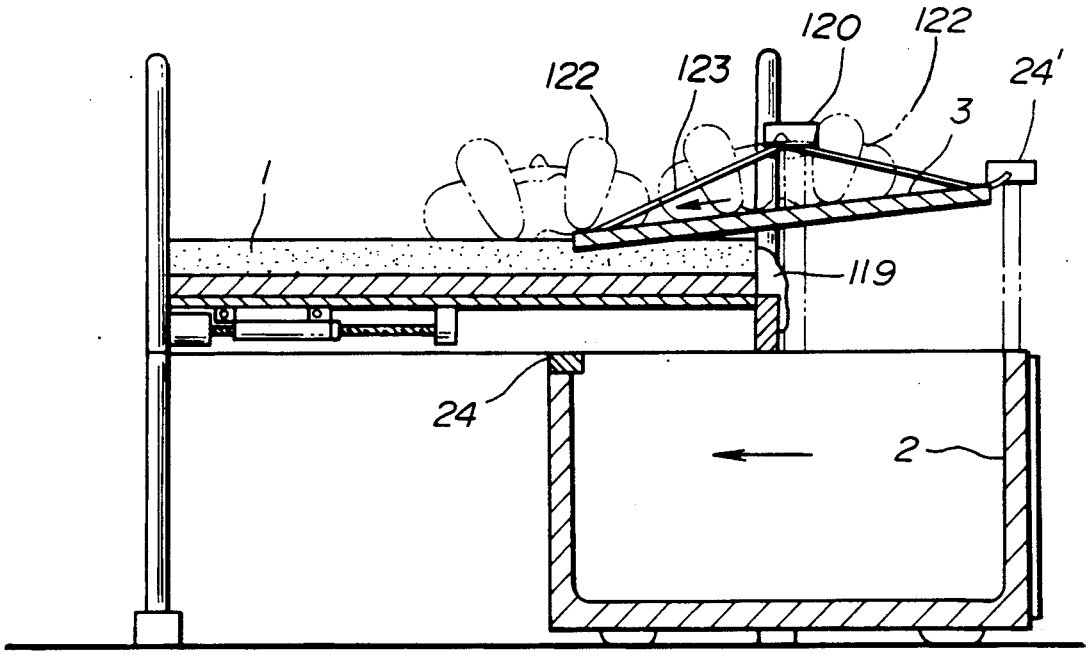
FIG. 21 is a sectional view showing the movement of a patient from a bath-tub to a bed using the bed shown in FIG. 19.

FIGS. 19 to 21 show another embodiment of the present invention in which a cushion 119 formed from an air bag is connected to the side of the bed 1 on the side of the bath-tub 2, and three elevating rods 24, 24' and 120 are provided on the opposed surface of the bath-tub 2.

In this embodiment, in order to move the patient from the bed to the bath-tub as shown in FIG. 20, a part of the bath-tub 2 is moved to the under portion of the bed, the cushion 119 is filled with air to inflate the former, and a sheet 121 is pulled to move the patient onto the mat 3. Then, the sheet 121 is removed, and the bath-tub 2 is pulled out of the under portion of the bed, after which the patient 122 is placed thereon and the mat 3 is moved down into the bath-tub 2.

After completion of bathing, the mat 3 is moved up to a level of the bed 1, after which the mat connected to the rope of the elevating rod 24 at the left end of the bath-tub is removed as shown in FIG. 21, and the elevating rods 120 and 24' in the central portion and at the right end are moved upwardly. Then, a part of the bath-tub 2 is slidably moved to the under portion of the bed and the mat 3 is slidably moved onto the bed 1. Subsequently, the patient 122 is slid from the mat 3 to move him onto the bed 1.

While in the above-described embodiment, an air bag is used as the cushion 119, it is noted that other resilient materials such as rubber, sponge or the like may be used.

The elevating rod 120 in the central portion in the above-described embodiment is designed similarly to the elevating rod in FIG. 7 but a rope is not inserted into the elevating rod. The rope 123 extending through the elevating rod in the central portion connects the elevating rod 120 and both sides of the mat. While the left and right elevating rods 24, 24' are designed as shown in FIG. 7, the head of the elevating rod at the left end in the above-described embodiment may be fitted into the bath-tub wall.

The bed of the present invention may be provided with all the living functions and nursing functions so that the aged confined in bed can operate the bed by himself while being in bed to daily enjoy a self supporting life.

For such purposes as described above, there can be mentioned a storage box for the necessities of life, a heating cabinet 110 and a refrigerator 111 for storing drinks such as milk and foods such as dishes, a cabinet for storing bathing goods, electric tooth brushes, nursing goods such as an oxygen inhaler and meters and devices such as a thermometer, a hemadinamometer, etc. For a patient who cannot take meals by himself, there may be provided an apparatus wherein a patient holds freely bendable pipe ends 112 and 113 at his mouth and when he depresses a button, heated or cooled drink or food are provided. In the above-described embodiment, the pipe 112 is connected to a cooling tank 116 above the refrigerator 111, and the pipe 111 is connected to a heating tank 117 above the heating cabinet. Furthermore, a large television set 114 for amusement may be provided within the room, and an automatically operated telephone for communication may be provided at a position accessible to the patient. In FIG. 12, reference numeral 97 denotes a control box, by which the tilting operation of the bed and mat, and concentrated control of instruments and machinery such as turning on and off of the television set can be made.

Furthermore, there may be provided an urgent alarm system in which when the aged who is living alone, depresses a switch in case of emergency, a radio receiver installed in the home receives a signal to transmit an urgent signal to a previously set destination through a telephone line, or a television telephone in which the aged in bed or the like and his family or nurse are viewed by a camera for telephone 115 so that they can talk while viewing the faces of each other.

It is suggested that the other party for the alarm system and TV telephone be part of an area monitoring center for monitoring the aged in bed in that particular area so as to obtain adequate instructions from doctors or nurses who always stay in this center, thus facilitating formation of an inarea synthetic welfare system.

The function of the present invention will be described hereinafter in accordance with FIG. 1.

When the bed 1 is slidably moved, the bath-tub 2 appears. The cover (not shown) is placed over the bath-tub 2. This cover is attracted toward the lower surface of the bed by the action of the magnet when the bed is slidably moved. The mat is supported at one side by the plastic rope 18 secured to the hook 15 of the movable tubular body and at the other side secured to the rope from the movable tubular body. When the elevating devices 24, 24' in the movable tubular body are moved upward manually or by the motor, the plastic rope 25 is pulled, and the mat 3 then assumes a horizontal position at the same level as the bed 1. Then, the bed is inclined at a predetermined angle in the direction of the mat as shown in FIG. 8 or FIG. 9 to roll the patient and transfer him to the mat. When the driving gear is rotated in the direction opposite to that used previously to move down the mat into the bath-tub, the movable tubular body 13 is moved to the mat portion of the foot portion passing the connection between the tubular bodies 11 and 12. The mat follows the shape of the lower surface of the bath-tub and is bended so as to hold the head above the hot bath. After the body and hair have been washed and the patient has been fully satisfied in the bath-tub, the mat is moved upward in a manner similar to the above. After the bed has been set to a horizontal position at a substantially same level as that of the bed, the elevating device 24' located away from the bed is moved upward to incline the mat 3 in the direction of the bed. Then, the patient is rolled and transfered from the mat 3 to the bed 1, after which the mat 3 is placed flat and the mat 3 is moved down, and the bed 1 is slidably moved to join with the bath-tub 2. When the power is turned off, the magnet is deenergized whereby the cover for the bath-tub 2 is disengaged from the bed and falls onto the bath-tub.

As described above, in the bed with a bath-tub according to the present invention, the bed and the bath-tub are slidable relative to each other, and the mat which is movable up and down within the bath-tub is disposed in the bath-tub. Therefore, even one nurse can give the aged confined in bed a bath easily and safely. If a bath water purifying mineral agent is mixed into the bath water, and even in case of incontinance by the patient, the feces or urine are decomposed, insolubilized, deodored and removed, which excellent effects have not at all been attained by the conventional bed and bath.

Furthermore, in the bed of the present invention, one can relieve himself without emanating an offensive smell in the room, and therefore, any mental pain of the patient caused by his constraint can be relieved.

What is claimed is:

1. An article comprising a bed with a bath-tub, the bed having a generally horizontal resting surface for a human body spaced from a supporting surface for the bed, the bath-tub being slidably mounted to the bed in the space between the resting surface and the supporting surface, said bath-tub having a mat disposed therein, said mat being movable up and down within the bath-tub with a human body laid thereon, said bath-tub further having means for tilting the mat to easily transfer a human body from the mat to the resting surface of the bed, said bed also including means for tilting the resting surface to easily transfer a human body from the resting surface of the bed to the mat.

2. An article according to claim 1, further including an apparatus for heating, circulating and purifying bath water diposed in said bath-tub so as to circulate and purify bath water and maintain a suitable temperature, and to generate bubbles having a supersonic cleaning effect.

3. An article according to claim 1, further including means for mixing a bath water purifying mineral agent into bath water of said bath-tub, said bath water purifying mineral agent having functions of separation, agglomeration and sterilization of organic matter, odor-prevention, and suppressing generation of steam.

4. An article according to claim 3, wherein said bath water purifying mineral agents include acidic additives containing a variety of metal salts and non-metal salts as main constituents, the additives obtained by dissolving vermiculite into aqueous solution of an inorganic acid.

5. An article according to claim 1, wherein said mat comprises two frames connected by a pivotable hinge such that the mat is bent when placed in the bottom of the bath-tub.

6. An article according to claim 1, wherein the bath-tub and the bed are capable of being slid over each other so as to overlap a portion of the mat with a part of the bed such that a patient thereon can be easily moved from the bed to the mat or from the mat to the bed.

7. An article according to claim 1, further including a leg wheel connected to a leg portion of said bath-tub, each leg wheel comprising a plurality of cylindrical wheels with the central portion of each of said cylindrical wheels rotatably connected to a lower end of the leg portion of the bath-tub, and endless belts stretched on said cylindrical wheels at opposed positions.

8. An article according to claim 1, further including caterpillars connected to both sides of said bath-tub, said caterpillars comprising endless belts stretched on a plurality of rollers, some of said rollers being rotatably fixed on said bath-tub, the remaining rollers being freely slidable, and the bath-tub further including a motor for rotating said rollers so as to slidably move the bath-tub relative to the bed.

9. An article comprising a bed with a bath-tub, the bed having a generally horizontal resting surface for a human body spaced from a supporting surface for the bed, the bath-tub being slidably mounted to the bed in the space between the resting surface and the supporting surface, said bath-tub having a mat disposed therein and supported by a frame including guide rails extending across the width of the bath-tub, said mat and frame being movable up and down within the bath-tub with a human body laid thereon, said movable mat having convex portions on the lower surface thereof each fitted into a guide rail of the frame such that said movable mat is reciprocatable horizontally on the guide rails between the bed and the bath-tub with a human body laid thereon.

10. An article according to claim 9, further including an apparatus for heating, circulating and purifying bath water disposed in said bath-tub so as to circulate and purify bath water and maintain a suitable temperature, and to generate bubbles having a supersonic cleaning effect.

11. An article according to claim 9, further including means for mixing a bath water purifying mineral agent into bath water of said bath-tub, said bath water purifying mineral agent having functions of separation, agglomeration and sterilization of organic matter, odor-prevention, and suppressing generation of steam.

12. An article according to claim 11, wherein said bath water purifying mineral agents include acidic additives containing a variety of metal salts and non-metal salts as main constituents, the additives obtained by dissolving vermiculite into aqueous solution of an inorganic acid.

13. An article according to claim 9, further including a leg wheel connected to a leg portion of said bath-tub, each leg wheel comprising a plurality of cylindrical wheels with the central portion of each of said cylindrical wheels rotatably connected to a lower end of the leg portion of the bath-tub, and endless belts stretched on said cylindrical wheels at opposed positions.

14. An article according to claim 9, further including caterpillars connected to both sides of said bath-tub, said caterpillars comprising endless belts stretched on a plurality of rollers, some of said rollers being rotatably fixed on said bath-tub, the remaining rollers being freely slided, and the bath-tub further including a motor for rotating said rollers so as to slidably move the bath-tub relative to the bed.

15. An article comprising a bed having a mat thereon and an associated bath-tub, a portion of the mat being movably partitioned so as to form an opening in the vicinity of a central portion of the mat, and further including a toilet bowl secured in said opening and including means for moving the bowl vertically, said toilet bowl including a bubble injecting pipe which serves to suppress odor during use, a hot water nozzle for washing the anus of a user of the toilet bowl and a hot air nozzle for drying the anus of a user of the toilet bowl.

16. An article according to claim 15, wherein the other end of the hot water nozzle is connected to said bath water heating, circulating and purifying device so as to be able to spurt bath water out of said nozzle.

* * * * *